US005308227A

United States Patent [19]

Gros et al.

[11] Patent Number: 5,308,227

[45] Date of Patent: May 3, 1994

[54] DRUM ROTOR FOR AN IMPULSE STEAM TURBINE HAVING BLADES MOUNTED IN LONGITUDINAL GROOVES, AND AN IMPULSE STEAM TURBINE INCLUDING SUCH A MOTOR

[75] Inventors: Jean-Pierre Gros, Villemomble; Guillaume Verschaeve, St Jean de Braye, both of France

[73] Assignee: GEC Alsthom SA, Paris, France

[21] Appl. No.: 1,675

[22] Filed: Jan. 7, 1993

[30] Foreign Application Priority Data

Jan. 8, 1992 [FR] France ..... 92 00122
Jan. 29, 1992 [FR] France ..... 92 00948

[51] Int. Cl.[5] ..... F01D 5/30

[52] U.S. Cl. ..... 416/219 R; 415/173.7; 416/198 A

[58] Field of Search ..... 416/198 A, 219 R; 415/199.5, 173.1, 173.4, 173.5, 173.7

[56] References Cited

U.S. PATENT DOCUMENTS 3,529,905 10/1970 Meginnis ..... 415/173.5
4,477,226 10/1984 Carreno .
4,655,683 4/1987 Chaplin ..... 415/173.7
4,813,850 3/1989 Partington ..... 416/219 R

FOREIGN PATENT DOCUMENTS 457240 11/1991 European Pat. Off. ..... 415/173.7
946406 6/1949 France .
2404102 4/1979 France .
7028810 2/1982 Japan ..... 415/173.1
2005359 4/1979 United Kingdom .

*Primary Examiner*—Edward K. Look
*Assistant Examiner*—Mark Sgantzos
*Attorney, Agent, or Firm*—Sughrue, Mion, Zinn, Macpeak & Seas

[57] ABSTRACT

A drum rotor for an impulse steam turbine having moving wheels constituted by rotor blades whose roots are provided with dovetails are locked in dovetail shaped grooves formed in the rotor. The grooves are longitudinal over at least a portion of the rotor. The roots of the blades of a moving wheel are separated from the roots of the blades of an adjacent moving wheel by dovetail shaped spacers. An optimum filling of the longitudinal grooves is effected for better interconnection of the caps of the rotor blades.

6 Claims, 4 Drawing Sheets

DRUM ROTOR FOR AN IMPULSE STEAM TURBINE HAVING BLADES MOUNTED IN LONGITUDINAL GROOVES, AND AN IMPULSE STEAM TURBINE INCLUDING SUCH A MOTOR

The present invention relates to an impulse steam turbine including a drum rotor on which blades are mounted that have roots provided with enlarged portions that serve as fastenings and that are received in grooves formed in the rotor. Such a drum rotor is described in French patent application FR-A-9 104 855. In that application, the grooves are circumferential.

BACKGROUND OF THE INVENTION

In order to install those blades, it is necessary to pivot their roots in the groove, such that the width of the groove is greater than the width a blade and equal to that of the blade root enlarged portions.

In addition, the filling of the groove is far from optimum since it may end up with a void equal to the clearance necessary to allow one blade root to pivot. This void then needs to be filled up with narrow wedges, but clamping is not ideal.

Furthermore, circumferential clearance exists between the caps and continuous connection does not exist.

SUMMARY OF THE INVENTION

In the impulse steam turbine of the invention, the mechanical performance of the blade roots is improved as is the clamping of the caps. The grooves are longitudinal over at least a portion of the rotor, and the roots of the blades of a moving wheel are separated from the roots of the blades of an adjacent moving wheel by spacers. In the rotor of the invention, the problem of blade pivoting is avoided and the filling of the grooves is optimum.

The spacers facing the hubs of the diaphragms may be provided with conventional fixed glands operating with clearance in the usual way or they may be provided with abradable glands that are glued and that operate with reduced clearance.

BRIEF DESCRIPTION OF THE DRAWINGS

An embodiment of the invention is described by way of example with reference to the accompanying drawings. in which.

DETAILED DESCRIPTION

Figure 1:
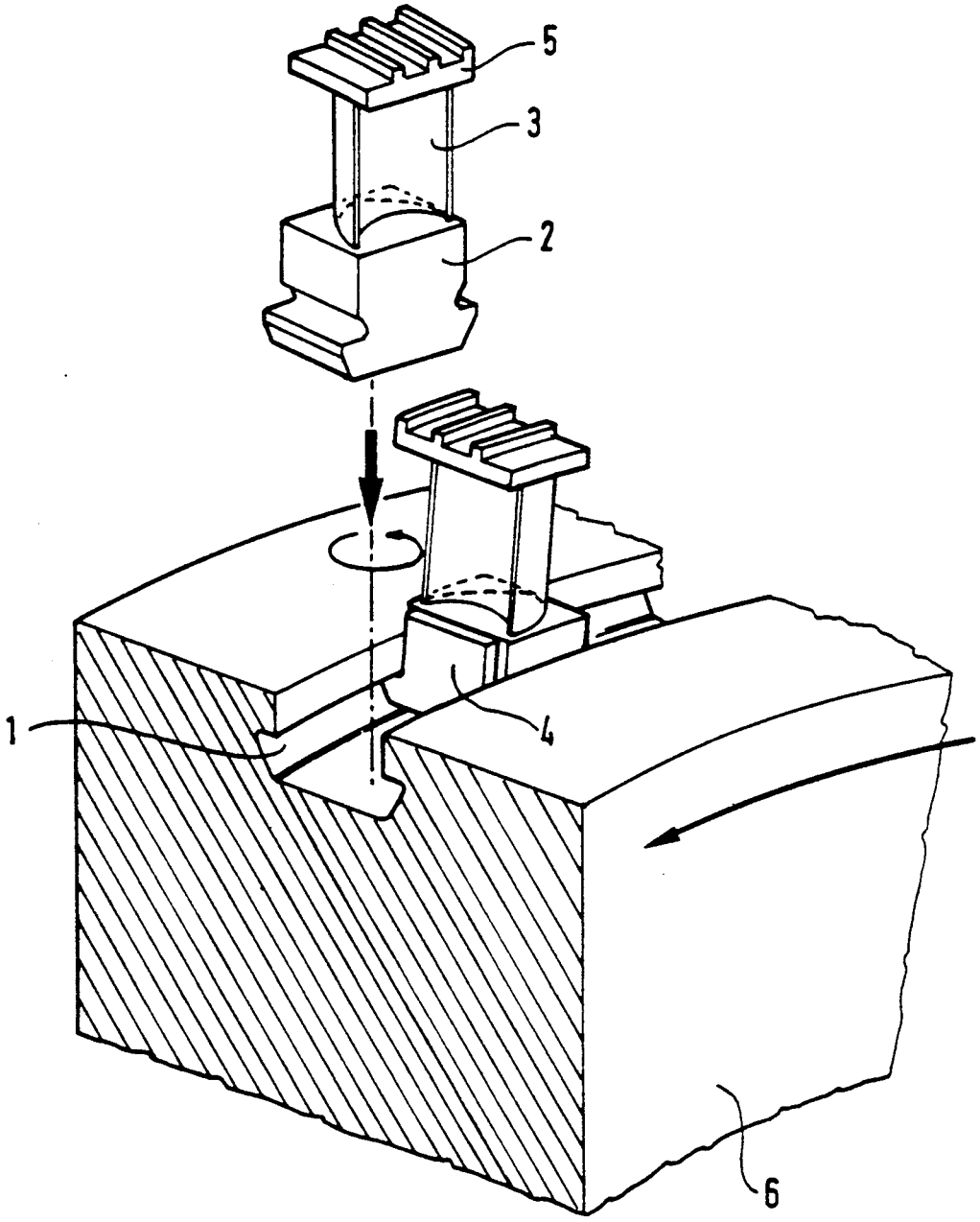
FIG. 1 PRIOR ART
FIG. 1 shows a portion of the rotor of FR-A-91 04 855.

FIG. 1 shows a portion of the drum rotor of Document FR-A-91 04 855 provided with an upsidedown T-shaped circumferential groove 1. The T-shaped root 2 of a rotor blade 3 is inserted into the groove 1 and the blade is then pivoted. Once all of the blades 3 are in place, wedges 4 are inserted that have the same section as a blade root 2, but are much thinner. The last wedges 4 are split in two in the vertical direction so as to enable them to be inserted, and the very last wedge is split in three.

The width of the grooves 1 is greater than the width of the roots 2.

Figure 2:
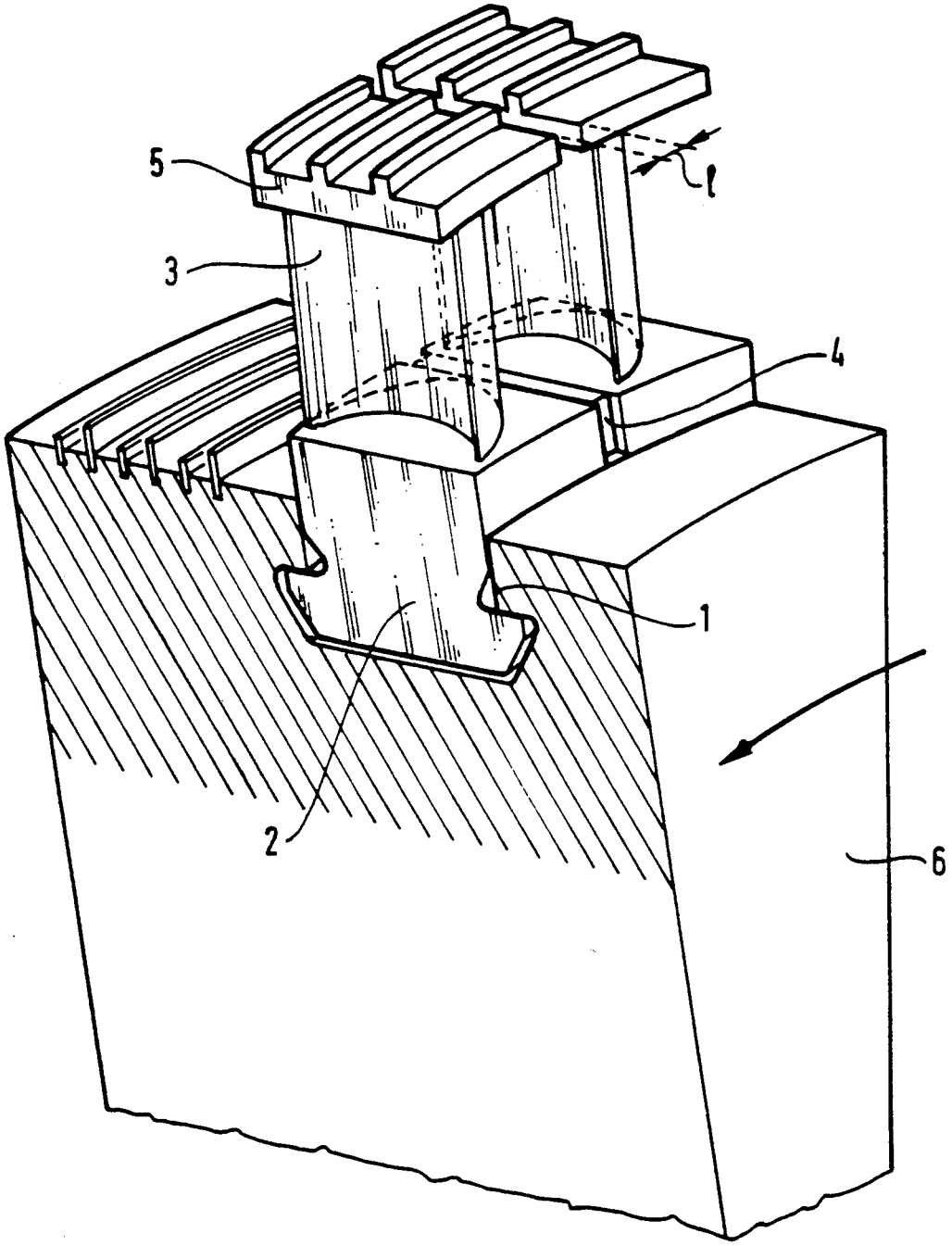
FIG. 2 PRIOR ART
FIG. 2 shows the FIG. 1 rotor with the blades installed.

In addition, the need to fill the gaps at the base by wedges 4 makes it possible to use continuously connected assemblies with only a small amount of twisting of the caps 5 of the blades 3. In general, circumferential clearance l remains between the caps 5, particularly when rotating after centrifugal and thermal elongation have taken place (see FIG. 2).

Figure 3:
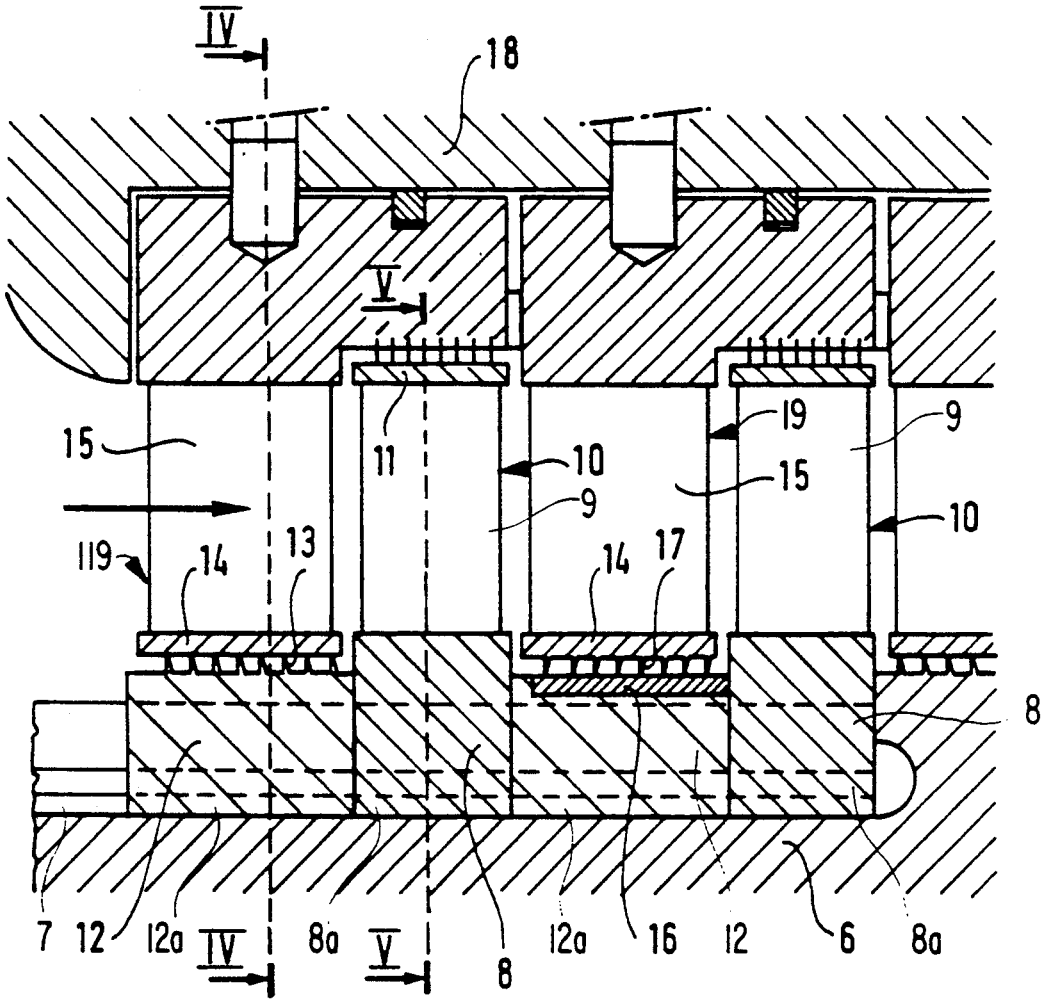
FIG. 3 is a fragmentary longitudinal section through the rotor and the turbine of the invention.
Figure 4:
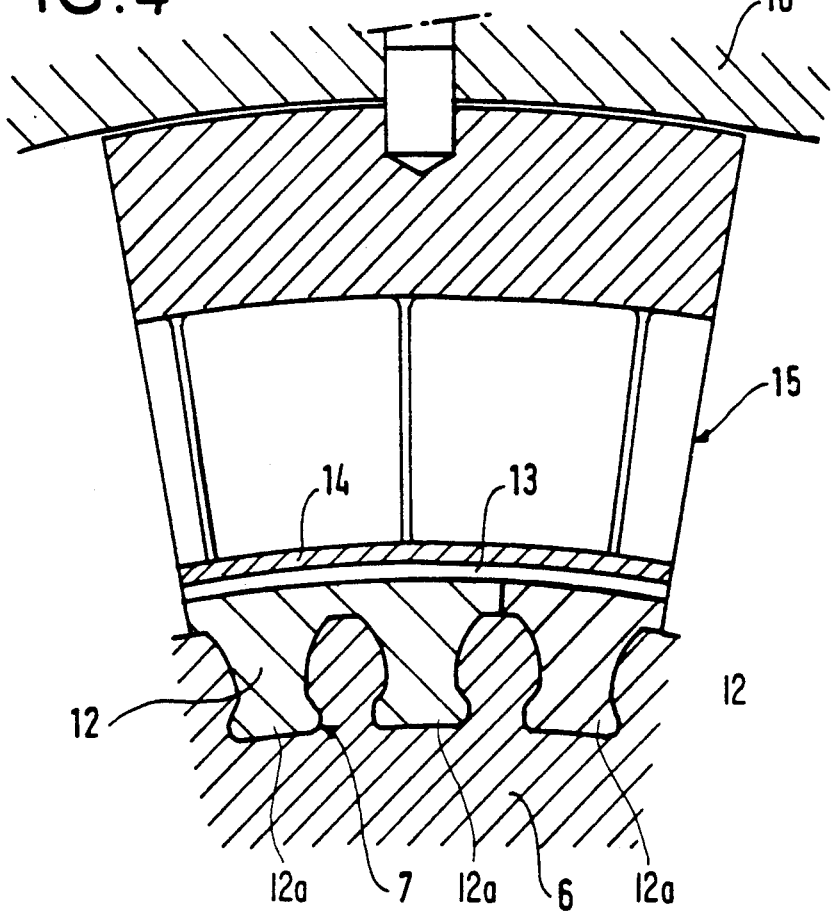
FIG. 4 is a section perpendicular to the axis of a diaphragm of the FIG. 3 turbine.
Figure 5:
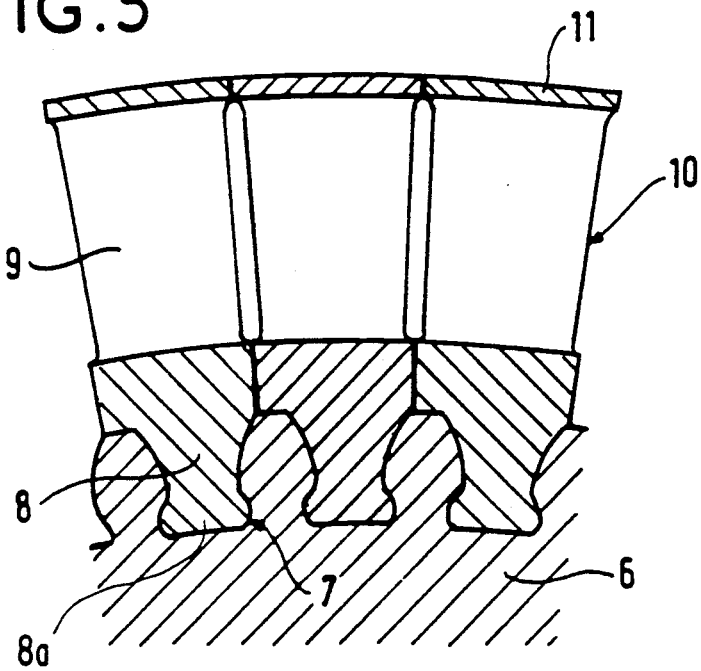
FIG. 5 is a section perpendicular to the axis of a moving wheel of the FIG. 3 rotor.

The installation of blades in accordance with the invention is shown in FIGS. 3 to 5.

The rotor 6 is provided with longitudinal dovetail shaped grooves 7 (i.e. parallel to the axis of the rotor) that are in the form of an upsidedown T-shape, and that are exactly complementary to the T-shape roots 8 of the blades 9 having a dovetail 8*a* that constitutes the crossbar of the T-shape.

It would also be possible to provide a dovetail 8*a* in the form of a stand for a Christmas tree.

There is no need to provide clearance for the roots in the dovetail shaped grooves since the roots 8 of the blades 9 are slid axially into the dovetail shaped grooves 7. In fact, each wheel is mounted as a whole, complete with its own clamping on the rotor, by being slid axially.

The roots 8 of the blades 9 in a given moving wheel 10 are joined together above the grooves 7, and the caps 11 in a single wheel 10 may be mounted so that they are in contact with one another.

Between two moving wheels 10 of blades 9, spacers 12 are slid that have the same dovetail shaped portions 12*a* as the roots 8 of the blades 9 in each of the grooves 7. The spacers 12 may be separate or they may be collected together in packets of three, four, or five.

These spacers or packets of spacers 12 are in contact with one another above the grooves 7.

In a first embodiment, the spacers 12 have sealing glands 13 disposed with clearance facing the hub 14 of the stator vanes 15 constituting the stationary wheel 19. The stator vanes 15 are preferably one-piece elements, i.e. without any diametral split at the horizontal join and they are thus threaded onto the rotor at the same time as the moving wheels 10 are installed thereon, with a stator vane 15 of a stationary wheel 19 being installed between successive pairs of moving wheels 10. The one-piece stator vanes 15 are isotropic and therefore of reduced thickness.

In the first embodiment, the spacers 12 are provided on their outside surfaces with glued-on abradable packing 16 disposed with very little clearance, having wipers or ribs 17 machined on the hub 14 of the fixed wheel that constitutes the stator vanes 15, thereby improving leak-proofing efficiency. It should be observed that leaks are already greatly reduced by using a drum rotor (small base diameter).

These spacers 12 provide thermal insulation for the rotor 6.

In addition, in the event of the stator portions 18 to which the stator vanes 15 are fixed becoming deformed, contact may occur between the stator vanes 15 and the rotor 6. In the event of such contact, the above assembly method protects the rotor 6, thereby avoiding deformation thereof.

The longitudinal dovetail grooves 7. FIGS. 5, 6, need occupy only a portion of the rotor 6, with the remainder thereof having circumferential grooves. Rotors of the invention must have the same number of rotor blades 9 in each moving wheel which means that the invention is particularly advantageous for HP rotors that normally have the same number of blades in all of the moving wheels 10.

We claim:

1. A drum rotor for an impulse steam turbine having moving wheels constituted by rotor blades having roots provided with dovetails, said dovetails being locked in dovetail shaped grooves formed in said rotor, and wherein the dovetail shaped grooves extend longitudinally over at least a portion of the rotor parallel to the rotor axis, wherein the dovetail roots of the rotor blades of a moving wheel are separated from the roots of the blades of an adjacent moving wheel by dovetail shaped spacers, and wherein said dovetail shaped grooves are exactly complementary to said dovetail shaped roots, and said dovetail shaped spacers and adjacent roots separated by a spacer are lodged with said spacers inside the same dovetail shaped longitudinal groove.

2. An impulse steam turbine including a drum rotor according to claim 1, wherein said moving wheels are separated by stator vanes fixed to a stator of the turbine, and said spacers are constituted by pieces having a same cross section as the roots of the rotor blades and face hubs of the stator vanes, and said pieces are separate.

3. An impulse steam turbine according to claim 2, wherein each of the spacers includes ribs for sealing purposes.

4. An impulse steam turbine according to claim 2, wherein the spacers are provided with abradable packing and wherein the hubs of the stator vanes carry ribs engaging said packing.

5. An impulse steam turbine according to claim 2, wherein the stator blades are one-piece elements.

6. An impulse steam turbine including a drum rotor according to claim 1, wherein moving wheels are separated by stator vanes fixed to a stator of the turbine, and said spacers are constituted by pieces having a same cross section as the roots of the rotor blades and face hubs of the stator vanes, and said pieces are interconnected in packets.

* * * * *